US012643762B2

(12) United States Patent
Shigematsu

(10) Patent No.: US 12,643,762 B2
(45) Date of Patent: Jun. 2, 2026

(54) METHOD FOR MANUFACTURING SHORT FIBERS, METHOD FOR MANUFACTURING NONWOVEN FABRIC, SHORT FIBER MANUFACTURING DEVICE, AND NONWOVEN FABRIC MANUFACTURING DEVICE

(71) Applicant: Daicel Corporation, Osaka (JP)

(72) Inventor: Masato Shigematsu, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 131 days.

(21) Appl. No.: 18/286,369

(22) PCT Filed: Apr. 14, 2021

(86) PCT No.: PCT/JP2021/015436
§ 371 (c)(1),
(2) Date: Oct. 11, 2023

(87) PCT Pub. No.: WO2022/219743
PCT Pub. Date: Oct. 20, 2022

(65) Prior Publication Data

US 2024/0199366 A1 Jun. 20, 2024

(51) Int. Cl.

| | |
|---|---|
| ***B65H 35/08*** | (2006.01) |
| ***B65H 23/04*** | (2006.01) |
| ***D02J 1/22*** | (2006.01) |
| ***D04H 1/425*** | (2012.01) |
| ***D04H 1/4391*** | (2012.01) |

(Continued)

(52) U.S. Cl.
CPC ..... *B65H 35/08* (2013.01); *B65H 23/04* (2013.01); *D02J 1/229* (2013.01); *D04H 1/425* (2013.01); *D04H 1/43918* (2020.05); *D06H 7/02* (2013.01); *D06M 11/05* (2013.01); *B65H 2301/5142* (2013.01); *B65H 2301/5143* (2013.01); *B65H 2301/515123* (2013.01);
(Continued)

(58) Field of Classification Search
None
See application file for complete search history.

(56) References Cited

U.S. PATENT DOCUMENTS

| | | | | |
|---|---|---|---|---|
| 2,346,258 | A | 4/1944 | Hooper | |
| 2010/0035500 | A1* | 2/2010 | Kimura | D04H 1/50 442/353 |

FOREIGN PATENT DOCUMENTS

| | | | |
|---|---|---|---|
| JP | 1-148818 | A | 6/1989 |
| JP | 2000-141290 | A | 5/2000 |
| JP | 2015-167628 | A | 9/2015 |

OTHER PUBLICATIONS

Written Opinion issued Jun. 29, 2021, in corresponding International Application No. PCT/JP2021/015436, 4 pages.
(Continued)

*Primary Examiner* — Jacob T Minskey
*Assistant Examiner* — Adrien J Bernard
(74) *Attorney, Agent, or Firm* — XSENSUS LLP

(57) ABSTRACT

A method for manufacturing short fibers includes relaxing entanglement of crimped cellulose acetate fibers in a tow band by applying a tension in a predetermined transfer direction to the tow band transferred in the transfer direction, the tow band containing the crimped cellulose acetate fibers and being impregnated with moisture, and forming short fibers by cutting the tow band in which the entanglement is relaxed.

10 Claims, 5 Drawing Sheets

(51) Int. Cl.
*D06H 7/02* (2006.01)
*D06M 11/05* (2006.01)
*D06M 101/06* (2006.01)

(52) U.S. Cl.
CPC ..... *D06M 2101/06* (2013.01); *D10B 2201/28* (2013.01)

(56) References Cited

OTHER PUBLICATIONS

Supplementary European Search Report mailed Jan. 17, 2025, in European Application No. 21936945.1, 9 pages.

* cited by examiner

METHOD FOR MANUFACTURING SHORT FIBERS, METHOD FOR MANUFACTURING NONWOVEN FABRIC, SHORT FIBER MANUFACTURING DEVICE, AND NONWOVEN FABRIC MANUFACTURING DEVICE

CROSS-REFERENCE TO RELATED APPLICATION

The present application is based on PCT filing PCT/JP2021/015436, filed Apr. 14, 2021, the entire contents of which are incorporated herein by reference.

TECHNICAL FIELD

The present disclosure relates to a method for manufacturing short fibers using crimped cellulose acetate fibers, a method for manufacturing a nonwoven fabric, a short fiber manufacturing device, and a nonwoven fabric manufacturing device.

BACKGROUND ART

Short fibers (staples) manufactured from crimped cellulose acetate fibers are known. The short fibers are used, for example, as a material for a nonwoven fabric. The nonwoven fabric using the short fibers takes advantage of the feeling of the cellulose acetate fibers and provides a feeling of use with a soft touch. In addition, a bulky nonwoven fabric can be manufactured by using short fibers obtained by cutting crimped cellulose acetate fibers.

When short fibers are produced from crimped cellulose acetate fibers, for example, after a tow band containing the fibers is drawn out from a packing box, entanglement of the fibers in the tow band is relaxed to facilitate treatment of the fibers. Thereafter, the tow band is cut by a cutter to form short fibers. As a type of cutter, for example, a guillotine type disclosed in Patent Document 1, a rotary type disclosed in Patent Document 2, and the like are known. When a nonwoven fabric is produced, a plurality of short fibers that are formed are subjected to a carding treatment in advance. Through the treatment, the plurality of short fibers are spread in a sheet shape, and the flow direction of the fibers is arranged.

CITATION LIST

Patent Document

Patent Document 1: JP 2000-141290 A
Patent Document 2: JP 01-148818 A

SUMMARY OF INVENTION

Technical Problem

Crimped cellulose acetate fibers are relatively bulky, elastic, and highly entangled. For this reason, short fibers containing crimped cellulose acetate fibers may be caught in a short fiber manufacturing device or may be clogged in a transfer path. In addition, the length dimension of the short fibers containing crimped cellulose acetate fibers is not stable because the orientation of the fibers with respect to the cutter varies. As a result, the manufacturing efficiency of the short fibers deteriorates.

An object of the present disclosure is to enable efficient manufacture of short fibers having a uniform length dimension when producing short fibers using crimped cellulose acetate fibers.

As a result of study by the inventor of the present invention, it is confirmed that a tow band containing crimped cellulose acetate fibers can be stretched and entanglement of the fibers can be relaxed by impregnating the tow band with moisture. The present disclosure is based on such knowledge.

A method for manufacturing short fibers according to an aspect of the present disclosure includes relaxing entanglement of crimped cellulose acetate fibers in a tow band by applying a tension in a predetermined transfer direction to the tow band transferred in the transfer direction, the tow band containing the crimped cellulose acetate fibers and being impregnated with moisture, and forming short fibers by cutting the tow band in which the entanglement is relaxed.

According to the above method, in the relaxing entanglement, entanglement of the plurality of crimped cellulose acetate fibers impregnated with moisture is relaxed, and elasticity of the cellulose acetate fibers at the time of cutting the tow band is reduced. Thus, the formed short fibers are prevented from, for example, being caught in a short fiber manufacturing device or being clogged in a transfer path. In addition, variation in the orientation of the fibers with respect to the cutter can be suppressed when the tow band is cut in the forming short fibers. As a result, short fibers having a uniform length dimension can be formed. This makes it possible to efficiently produce short fibers of stable quality by a relatively simple method.

In the relaxing entanglement, the tow band may be impregnated with moisture in such a manner that the tow band immediately before cutting in the forming short fibers has a moisture amount of a value in a range from 7 mass % to 80 mass %. This makes it possible to easily impregnate the tow band with an appropriate amount of moisture necessary for forming short fibers having a uniform length dimension by stretching the tow band and relaxing entanglement of the fibers. Thus, the load applied to the short fibers during drying of the short fibers can be reduced. In addition, the manufacturing equipment can be made less likely to be wet with water. Thus, the burden of facility management can be reduced.

In the relaxing entanglement, the tow band may be heated to promote relaxation of the entanglement. By heating the tow band in this manner, the cellulose acetate fibers in the tow band at the time of cutting can be plasticized in a certain range and the elasticity of the cellulose acetate fibers can be reduced. Thus, entanglement of the cellulose acetate fibers in the tow band can be further reduced.

In the relaxing entanglement, the tow band may be impregnated with moisture by bringing a mist containing moisture into contact with the tow band. This makes it possible to prevent the tow band from being excessively wet with moisture. Thus, it is possible to reduce the amount of water used for relaxing the entanglement of the fibers of the tow band. In addition, it is possible to reduce labor and energy consumption for drying the tow band after the relaxing entanglement. Further, it is possible to suppress the short fiber manufacturing device from being excessively wet by the tow band impregnated with moisture.

The mist may contain vapor of moisture. This makes it possible to more favorably prevent the tow band from being excessively wet with moisture. In this case, in the relaxing entanglement, the mist may be brought into contact with the tow band in such a manner that the tow band immediately before cutting in the forming short fibers has a moisture amount of a value in a range from 7 mass % to 15 mass %. This makes it possible to obtain an appropriate amount of moisture to relax the entanglement of the fibers of the tow band and to more favorably prevent the tow band from being excessively wet with moisture.

In the relaxing entanglement, the mist may be brought into contact with the tow band in such a manner that the tow band immediately before cutting in the forming short fibers has a moisture amount of a value in a range from 7 mass % to 35 mass %. The method may further include drying moisture attached to the short fibers after the forming short fibers.

In the forming short fibers, the tow band may be cut by a rotary cutter that includes a cutting blade disposed on a circumferential surface thereof, is pivotally supported, and is rotationally driven in such a manner that the tow band comes into contact with the cutting blade. By using the rotary cutter having such a configuration, the tow band being transferred can be continuously cut and the short fibers can be formed more efficiently.

A method for manufacturing a nonwoven fabric according to an aspect of the present disclosure includes manufacturing a nonwoven fabric using short fibers formed by any one of the methods for manufacturing short fibers described above.

A short fiber manufacturing device according to an aspect of the present disclosure includes an entanglement relaxing unit configured to relax entanglement of crimped cellulose acetate fibers in a tow band by applying a tension in a predetermined transfer direction to the tow band transferred in the transfer direction, the tow band containing the crimped cellulose acetate fibers and being impregnated with water, and a short fiber forming unit configured to form short fibers by cutting the tow band in which the entanglement is relaxed.

A nonwoven fabric manufacturing device according to an aspect of the present disclosure includes the short fiber manufacturing device, and a nonwoven fabric forming unit configured to form a nonwoven fabric using the short fibers formed by the short fiber forming unit.

Advantageous Effects of Invention

According to each aspect of the present disclosure, in the case of producing short fibers by using crimped cellulose acetate fibers, short fibers having a uniform length dimension can be efficiently produced.

DESCRIPTION OF EMBODIMENTS

Embodiments of the present disclosure will be described below with reference to the drawings.

First Embodiment

Figure 1:
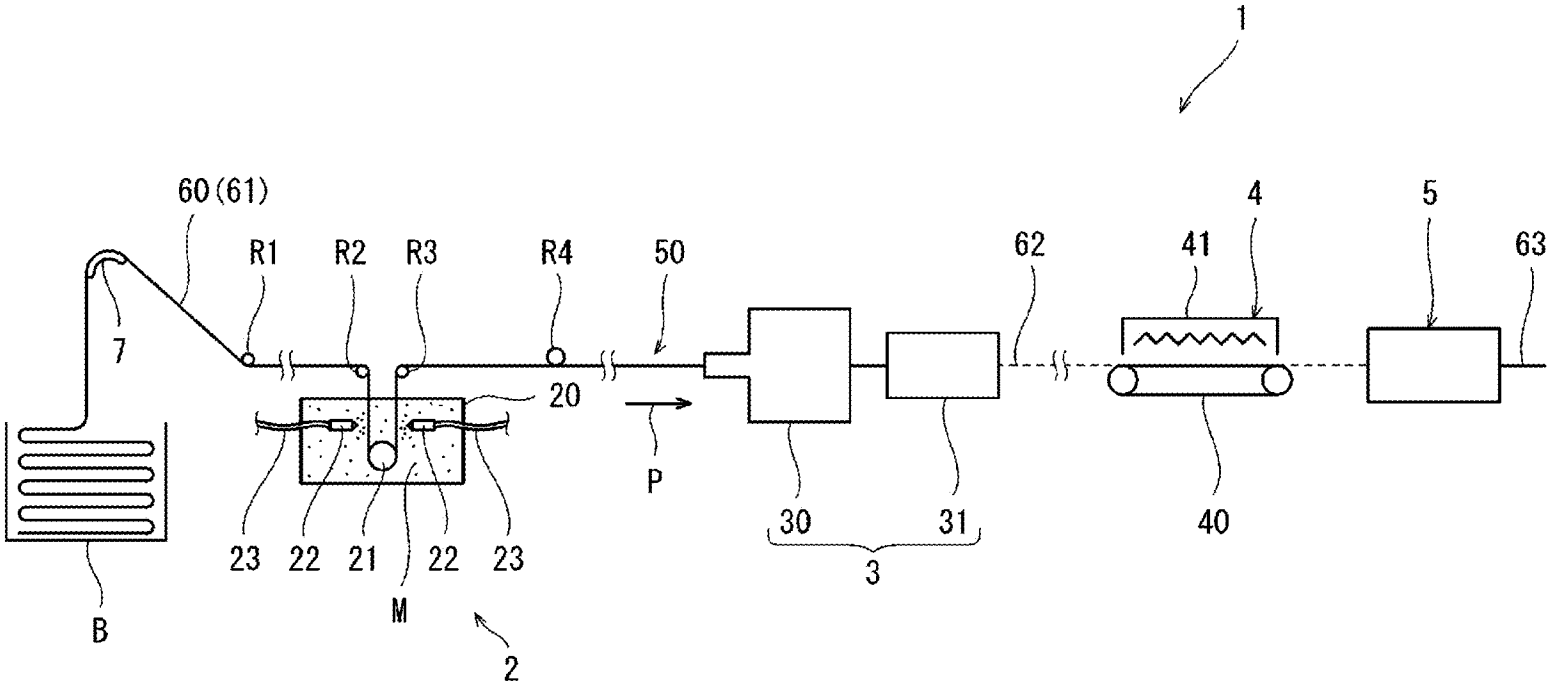
FIG. 1 is a schematic diagram of a nonwoven fabric manufacturing device according to a first embodiment.
Figure 2:
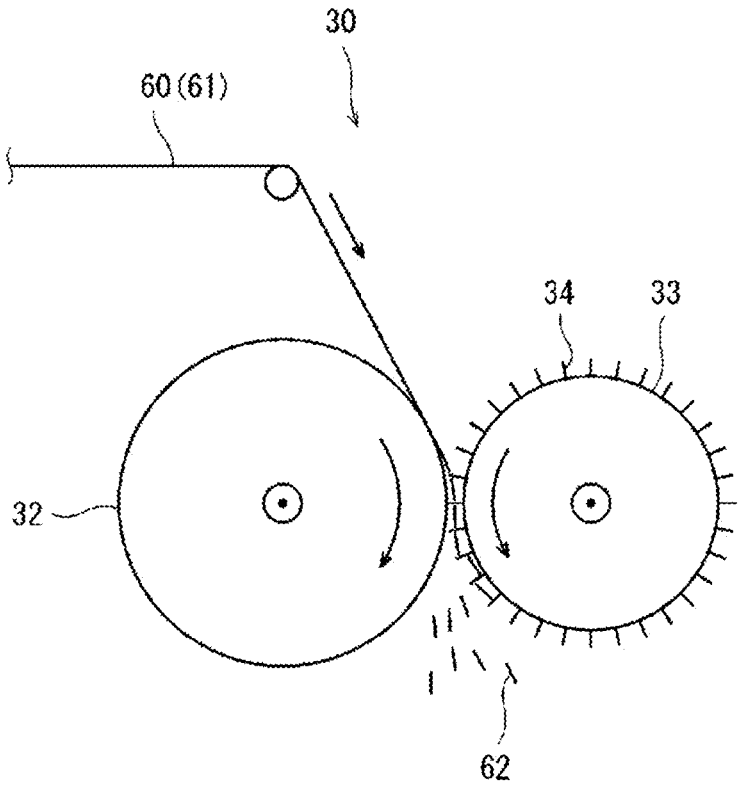
FIG. 2 is a schematic view illustrating an internal structure of a cutting mechanism included in a short fiber forming unit of FIG. 1.

FIG. 1 is a schematic diagram of a nonwoven fabric manufacturing device 1 according to a first embodiment. FIG. 2 is a schematic view illustrating an internal structure of a cutting mechanism 30 included in a short fiber forming unit 3 of FIG. 1. The nonwoven fabric manufacturing device 1 shown in FIG. 1 is configured to draw out a bale-shaped tow band 60 folded and packed in a packing box B and form short fibers 62 using the tow band 60. That is, the nonwoven fabric manufacturing device 1 of the present embodiment also serves as a short fiber manufacturing device. The short fibers 62 are used as a material of a nonwoven fabric 63. The nonwoven fabric referred to herein is a nonwoven fabric in accordance with JIS L 0222:2001.

The tow band 60 includes crimped cellulose acetate fibers 61 (hereinafter, also referred to as CA fibers 61). Thus, the tow band 60 has stretchability. The tow band 60 is in a state where a plurality of CA fibers 61 are entangled with each other. The CA fibers 61 in the tow band 60 drawn out from the packing box B are long fibers. The CA fibers 61 are crimped by a primary crimp which is a minimum crimp unit, and are crimped by a secondary crimp which is a crimp unit larger than the primary crimp. The CA fibers 61 may be further crimped by a higher-order crimp which is a crimp unit larger than the secondary crimp.

Each of the total denier (TD) and the filament denier (FD) of the tow band 60 may be appropriately set. As an example, the TD of the tow band 60 may be a value of millions, hundreds of thousands, tens of thousands, or thousands of units. In another example, the TD of the tow band 60 is a value in a range from 3 million to 5 million, and more preferably a value in a range from 1 million to 2 million. In another example, the TD of the tow band 60 is a value in a range from 100,000 to 700,000, and more preferably a value in a range from 100,000 to 300,000. In another example, the TD of the tow band 60 is a value in a range from 5000 to 100,000, and more preferably a value in a range from 10,000 to 50,000.

The FD of the tow band 60 is, for example, a value in a range of 10 or less. In another example, the FD of the tow band 60 is a value in a range from 1 to 8. The tow band 60 of the present embodiment is transferred on a predetermined transfer path 50 provided in the nonwoven fabric manufacturing device 1 while a relatively low tension (load) having a value in a range from 2 mgf to 50 mgf per denier is applied in a transfer direction P.

As illustrated in FIGS. 1 and 2, the nonwoven fabric manufacturing device 1 includes a guide member 7 configured to guide the tow band 60 drawn out from the packing box B, and a plurality of guide rolls R1 to R4 that are disposed apart from each other in the predetermined transfer direction P and is configured to guide the tow band 60. The nonwoven fabric manufacturing device 1 also includes an entanglement relaxing unit 2 that is disposed in the middle of the transfer path 50 for the tow band 60 and is configured to relax the entanglement of the CA fibers 61 in the tow band 60, and a short fiber forming unit 3 configured to cut the tow band 60 in which the entanglement of the CA fibers 61 is relaxed to form the short fibers 62. The nonwoven fabric manufacturing device 1 also includes a drying unit 4 configured to dry the short fibers 62 discharged from the short fiber forming unit 3, and a nonwoven fabric forming unit 5 configured to form the nonwoven fabric 63 by entangling the short fibers 62 that have passed through the drying unit 4.

The entanglement relaxing unit 2 is configured to impregnate with moisture the tow band 60 including the CA fibers 61 transferred and crimped in the transfer direction P while applying a tension in the transfer direction P. As an example, the entanglement relaxing unit 2 is configured to adjust the tension applied to the tow band 60 by changing the rotation speed of a rotating roll 21 described later. The tension is applied to the tow band 60 from immediately before the tow band 60 is introduced into the entanglement relaxing unit 2 to immediately before the tow band 60 is cut by a cutting mechanism 30 of the short fiber forming unit 3. This causes the entanglement relaxing unit 2 to stretch the CA fibers 61 and relax the entanglement of the CA fibers 61 in the tow band 60. The entanglement relaxing unit 2 of the present embodiment is configured to impregnate the tow band 60 with moisture by bringing a mist M into contact with the tow band 60. The mist M referred to in this specification is fine particles of a liquid dispersed in a gas and containing moisture. The mist M includes at least one of vapor or fine droplets.

The tension applied to the tow band 60 may also be adjusted by, for example, changing the load to be applied from the rotating roll 21 to the tow band 60. For example, in this case, when the relative position of the rotating roll 21 with respect to the tow band 60 is shifted downward, the tension applied to the tow band 60 is increased. For example, when the relative position of the rotating roll 21 with respect to the tow band 60 is shifted upward, the tension applied to the tow band 60 is decreased. The tension applied to the tow band 60 may also be adjusted by changing the material of the rotating roll 21 or by fixing the relative position of the rotating roll 21 to the tow band 60 at a predetermined position.

The mist M of the present embodiment includes, for example, vapor. In the present embodiment, the vapor is heated vapor. The temperature of the heated vapor may be set as appropriate but is higher than room temperature (25° C.) as an example. In another example, the vapor is superheated vapor superheated to a boiling point (100° C.) or higher. The particle size of the vapor is, for example, a value in a range from 0.3 nm to 40 nm. The entanglement relaxing unit 2 is configured to impregnate the tow band 60 with moisture while heating the tow band 60 by bringing heated vapor into contact with the tow band 60.

The entanglement relaxing unit 2 includes a housing 20 filled with the mist M, at least one rotating roll 21 pivotally supported inside the housing 20 and having a circumferential surface around which the tow band 60 is wound, and at least one nozzle 22 configured to spray the mist M to the tow band 60 inside the housing 20. A rear end of the nozzle 22 is connected with a supply pipe 23 configured to supply moisture from the outside of the entanglement relaxing unit 2 to the nozzle 22. For example, when the rotation speed of the rotating roll 21 increases, the tension applied to the tow band 60 increases. When the rotation speed of the rotating roll 21 decreases, the tension applied to the tow band 60 decreases.

As a result of the entanglement relaxing unit 2 impregnating the tow band 60 with moisture, the moisture amount of the tow band 60 immediately before cutting in the short fiber forming unit 3 becomes higher than the moisture amount of the tow band 60 before being impregnated with moisture by the entanglement relaxing unit 2 (equilibrium moisture content in accordance with JIS L 1013:2010). As an example, the entanglement relaxing unit 2 of the present embodiment is configured to adjust the spray amount of the mist M in such a manner that the tow band 60 immediately before cutting in the short fiber forming unit 3 has a moisture amount of a value in a range from 7 mass % to 80 mass %. The spray amount of the mist M is adjusted by, for example, at least one of the amount of moisture supplied to the nozzle 22 per unit time or the transfer speed of the tow band 60. By adjusting the spray amount of the mist M to a value within the above-described range, it is possible to ensure the moisture amount necessary for plasticizing the CA fibers 61 in the tow band 60 as described later and to easily adjust the moisture amount to avoid an excessive moisture amount. The entanglement relaxing unit 2 of the present embodiment is configured to further bring the mist M into contact with the tow band 60 in such a manner that the tow band 60 immediately before cutting in the short fiber forming unit 3 has a moisture amount of a value in a range from 7 mass % to 15 mass %.

The mist M may contain at least one additive of an oil agent, a softening agent, an antistatic agent, or the like. By impregnating the CA fibers 61 with an additive, the characteristics of the nonwoven fabric 63 can be changed by the additive. In addition, by adjusting at least one of the spray amount of the mist M or the spraying direction of the mist M from the nozzle 22, the CA fibers 61 in the tow band 60 can be locally impregnated with the additive. The tow band 60 may be impregnated with the additive separately from the mist M for the purpose of adjusting the amounts of these additives with which the tow band 60 is impregnated separately from the moisture amount with which the tow band 60 is impregnated.

The short fiber forming unit 3 is a long fiber bundle cutting unit. The short fiber forming unit 3 includes a cutting mechanism 30 configured to cut the CA fibers 61 to a predetermined length dimension to form the short fibers 62, and a carding machine 31 configured to perform a carding treatment on the plurality of short fibers 62 formed. The cutting mechanism 30 includes a guide roll (push roll) 32 rotatably supported to guide the tow band 60 by bringing the tow band 60 into contact with a circumferential surface thereof, and a rotary cutter 33 configured to cut the tow band 60 guided by the guide roll 32. The rotary cutter 33 includes a cutting blade 34 disposed on its circumferential surface and is rotatably supported. The guide roll 32 and the rotary cutter 33 are rotationally driven in such a manner that the cutting blade 34 of the rotary cutter 33 comes into contact with the tow band 60 transferred on the circumferential surface of the guide roll 32. A structure in which the guide roll 32 and the rotary cutter 33 are combined is also referred to as an EC cutter.

In the present embodiment, the distance between the cutting edge of the cutting blade 34 and the circumferential surface of the guide roll 32 is set to a distance at which the CA fibers 61 at the outermost circumference of the tow band 60 wound around the circumferential surface of the guide roll 32 come into contact with the cutting blade 34 and are cut. The length dimension of the short fibers 62 formed by the short fiber forming unit 3 may be appropriately set. The length dimension of the short fibers 62 of the present embodiment is, for example, a value in a range from 1 mm to 80 mm. In another example, the length dimension is a value in a range from 1 mm to 9 mm. In another example, the length dimension is a value in a range from 30 mm to 80 mm. The length dimension of the short fibers 62 is not limited to these ranges.

The drying unit 4 includes a transfer mechanism 40 configured to transfer the short fibers 62 discharged from the short fiber forming unit 3 and a heating unit 41 configured to heat and dry the short fibers 62 transferred by the transfer mechanism 40. The nonwoven fabric forming unit 5 is configured to form the nonwoven fabric 63 by entangling the dried short fibers 62 with each other. The nonwoven fabric forming unit 5 is configured to adjust the thickness dimension, the tactile feel, the size of fiber gaps, or the like of the nonwoven fabric 63 by adjusting the entanglement of the short fibers 62 after drying. When only the short fiber manufacturing device is configured, for example, the carding machine 31 and the nonwoven fabric forming unit 5 are omitted.

As illustrated in FIGS. 1 and 2, when the nonwoven fabric manufacturing device 1 is driven, the bale-shaped tow band 60 is drawn out from the packing box B. The tow band 60 is transferred in the transfer direction P while being guided by the guide member 7 and the guide rolls R1 to R4. The transferred tow band 60 is introduced into the housing 20 filled with the mist M in the entanglement relaxing unit 2. The tow band 60 is transferred inside the housing 20 while being wound around the circumferential surface of the rotating roll 21.

At this time, the tow band 60 is impregnated with the mist M by at least one nozzle 22 while a relatively low tension (load) having a value in a range from 2 mgf to 50 mgf per denier is applied to the tow band 60 in the transfer direction P. As an example, the nozzle 22 is configured to spray the mist M onto the tow band 60 from a plurality of directions including a direction perpendicular to the surface of the tow band 60. After coming into contact with the surface of the tow band 60, the mist M permeates into the tow band 60. The tow band 60 has abundant fiber gaps. Thus, the mist M comes into direct contact with the plurality of CA fibers 61 inside and outside the tow band 60 through the fiber gaps. This causes the plurality of CA fibers 61 included in the tow band 60 to be impregnated with moisture. Each of the CA fibers 61 is plasticized by being impregnated with moisture, and thus, high-order crimps of at least secondary crimp or higher crimp become gentle.

Here, the nozzle 22 of the present embodiment is configured to spray heated vapor to the tow band 60. The CA fibers 61 in the tow band 60 are plasticized through both moisture and heating by being impregnated with the heated vapor. As a result, the elasticity of the plurality of CA fibers 61 is reduced and the entanglement relaxing is promoted. In the present embodiment, the CA fibers 61 can be easily plasticized by impregnating the tow band 60 with moisture and heating the tow band 60. Thus, it is possible to reduce the amount of moisture used for relaxing the entanglement of the CA fibers 61.

The tow band 60 having passed through the entanglement relaxing unit 2 is transferred in the transfer direction P toward the short fiber forming unit 3 in a state where the tension is applied. In the present embodiment, a relatively small amount of moisture is sprayed as vapor onto the tow band 60 in the entanglement relaxing unit 2. Thus, there is no need for removing excess moisture from the tow band 60 between the entanglement relaxing unit 2 and the short fiber forming unit 3. Thus, the nonwoven fabric manufacturing device 1 can be simplified.

The transferred tow band 60 is introduced into the cutting mechanism 30 in the short fiber forming unit 3. As illustrated in FIG. 2, at this time, the tow band 60 is transferred while being guided by the circumferential surface of the rotationally driven guide roll 32 in a state where the tension is applied, and comes into contact with the cutting blade 34 of the rotationally driven rotary cutter 33. As a result, the CA fibers 61 in the tow band 60 are cut to a predetermined length dimension to form a plurality of short fibers 62.

Here, in the present embodiment, the moisture amount of the tow band 60 introduced into the cutting mechanism 30 is relatively small. Thus, for example, a situation is prevented in which the tow band 60 containing excessive moisture is clogged between the guide roll 32 and the rotary cutter 33, or the CA fibers 61 in the tow band 60 before and after cutting stick to the guide roll 32 or the rotary cutter 33 due to moisture and become difficult to be discharged. In the present embodiment, the plurality of CA fibers 61 of the tow band 60 are cut by the cutting blade 34 in a state where the entanglement is relaxed and the tension is applied. Thus, the orientation of the CA fibers 61 with respect to the cutting blade 34 is stabilized. As a result, the tow band 60 is cut with a uniform length dimension by the rotary cutter 33. The short fibers 62 thus formed are continuously discharged from the short fiber forming unit 3. In the present embodiment, by employing the rotary cutter 33, the short fibers 62 are formed while the tow band 60 is transferred. Thus, the short fibers 62 are efficiently formed.

The plurality of short fibers 62 formed are then subjected to a carding treatment by the carding machine 31. Through the treatment, the thickness dimension of the short fibers 62 and the flow direction of the short fibers 62 are adjusted. In the present embodiment, the short fibers 62 to be introduced into the carding machine 31 are plasticized by impregnation with moisture. Thus, the plurality of short fibers 62 are prevented from being entangled with the carding machine 31 or being caught by the needles of the carding machine 31 to be unable to pass through the carding machine 31, but they are favorably carded.

As illustrated in FIG. 1, the plurality of short fibers 62 carded are transferred in the transfer direction P and introduced into the drying unit 4. The short fibers 62 are dried by the heating unit 41 while being transferred by the transfer mechanism 40. This causes the short fibers 62 to be dried and have a predetermined moisture amount. The short fibers 62 introduced into the drying unit 4 do not have a large amount of moisture. Thus, in the drying unit 4, the short fibers 62 are dried relatively slightly, and the load received by heating is reduced. The plurality of short fibers 62 having passed through the drying unit 4 are introduced into the nonwoven fabric forming unit 5. In the nonwoven fabric forming unit 5, the plurality of short fibers 62 are entangled based on, for example, a needle punching method. The nonwoven fabric 63 is thus formed.

In the entanglement relaxing unit 2, the tow band 60 is impregnated with moisture and stretched. Thus, in the short fiber forming unit 3, the elasticity of the CA fibers 61 at the time of cutting the tow band 60 is reduced, and the crimps of the CA fibers 61 become gentle. Thereafter, the moisture amount of the short fibers 62 is reduced by drying, and thus, in the nonwoven fabric forming unit 5, the feeling of the CA fibers 61 is utilized to obtain the nonwoven fabric 63 having a soft and comfortable touch.

Examples of the method of forming the nonwoven fabric 63 by the nonwoven fabric forming unit 5 include any known method such as a dry method, a wet method, a chemical bond method, and a hydroentanglement method, in addition to the needle punching method. The nonwoven fabric 63 discharged from the nonwoven fabric forming unit 5 is cut to a predetermined length dimension as necessary. When the moisture amount of the plurality of short fibers 62 at the time of being introduced into the nonwoven fabric forming unit 5 is appropriate, the drying unit 4 may be omitted.

In this manner, a method for manufacturing the short fibers 62 of the present embodiment includes relaxing entanglement of the CA fibers 61 in the tow band 60 by applying a tension in a predetermined transfer direction P to the tow band 60 transferred in the transfer direction P, the tow band 60 containing the crimped CA fibers 61 and being impregnated with moisture, and forming the short fibers 62 by cutting the tow band 60 in which the entanglement of the CA fibers 61 is relaxed. In the forming short fibers of the present embodiment, the tow band 60 in which the entanglement of the CA fibers 61 is relaxed is cut in a state where the tension is applied, and the short fibers 62 are formed.

The method for manufacturing the short fibers 62 of the present embodiment includes, as an example, performing preparation for impregnating the tow band 60 with moisture in the relaxing entanglement (as an example, setting of the entanglement relaxing unit 2 in the present embodiment) before the relaxing entanglement. The method for manufacturing the short fibers 62 of the present embodiment includes, as an example, drying moisture attached to the short fibers 62 after the forming short fibers. In the method for manufacturing the nonwoven fabric 63 according to the present embodiment, the nonwoven fabric 63 is manufactured by using the manufactured short fibers 62.

As described above, the method for manufacturing the nonwoven fabric 63 of the present embodiment includes the relaxing entanglement and the forming short fibers. According to this manufacturing method, in the relaxing entanglement, the entanglement of the plurality of CA fibers 61 that are crimped and impregnated with moisture is relaxed, and the elasticity of the CA fibers 61 at the time of cutting the tow band 60 is reduced. Thus, in the nonwoven fabric manufacturing device 1, the formed short fibers 62 are prevented from, for example, being caught in the nonwoven fabric manufacturing device 1 or being clogged in the transfer path 50. In addition, variation in the orientation of the CA fibers 61 with respect to the cutter 33 can be suppressed when the tow band 60 is cut in the forming short fibers. As a result, the short fibers 62 having a uniform length dimension can be efficiently formed. This makes it possible to efficiently produce short fibers 62 of stable quality by a relatively simple method.

In addition, according to the manufacturing method, the CA fibers 61 can be stretched and the entanglement of the plurality of CA fibers 61 can be relaxed by impregnating the tow band 60 with moisture and applying a tension to the tow band 60 in the transfer direction P. Thus, for example, an opening roll for mechanically opening the tow band 60 or a gas opening device for opening the tow band 60 with gas is not required. Thus, the nonwoven fabric manufacturing device 1 can be simplified. In addition, according to the present embodiment, even when the tow band 60 configured to be bulky because of the crimped CA fibers 61 is used, the short fibers 62 having a uniform length dimension can be efficiently formed.

In addition, according to the manufacturing method, the short fibers 62 having a uniform length dimension can be efficiently formed by performing the relaxing entanglement using moisture. Thus, for example, reducing the number of crimps by modifying the tow band 60 with a chemical agent before forming the short fibers 62 is not required. Further, since moisture is used in the relaxing entanglement, the short fibers 62 can be efficiently formed by a relatively safe method. In addition, according to the method, the crimp of the short fibers 62 can be maintained to some extent even when the relaxing entanglement is performed. Thus, the bulky nonwoven fabric 63 can be manufactured by using the crimped short fibers 62.

In addition, in the forming short fibers of the present embodiment, the tow band 60 in which the entanglement of the CA fibers 61 is relaxed is cut in a state where the tension is applied, and the short fibers 62 are formed. This enables the orientation of the CA fibers 61 when the tow band 60 is cut to be further stabilized. Thus, the short fibers 62 having a uniform length dimension can be formed more easily.

In the relaxing entanglement of the present embodiment, the tow band 60 is impregnated with moisture in such a manner that the tow band 60 immediately before cutting in the forming short fibers has a moisture amount of a value in a range from 7 mass % to 80 mass %. This makes it possible to easily impregnate the tow band 60 with an appropriate amount of moisture necessary for forming short fibers 62 having a uniform length dimension by stretching the tow band 60 and relaxing entanglement of the CA fibers 61. Thus, the load applied to the short fibers 62 during drying of the short fibers 62 can be reduced. In addition, the manufacturing equipment can be made less likely to be wet with water. Thus, the burden of facility management can be reduced.

In the relaxing entanglement of the present embodiment, relaxation of entanglement of the CA fibers 61 is promoted by heating the tow band 60. By heating the tow band 60 in this manner, the CA fibers 61 in the tow band 60 at the time of cutting can be plasticized in a certain range, and the elasticity of the short fibers 62 can be reduced. Thus, the entanglement of the CA fibers 61 in the tow band 60 can be further reduced.

In the relaxing entanglement, the tow band 60 is impregnated with moisture by bringing the mist M containing moisture into contact with the tow band 60. This makes it possible to prevent the tow band 60 from being excessively wet with moisture, for example. Thus, it is possible to reduce the amount of water used for relaxing the entanglement of the CA fibers 61. In addition, it is possible to reduce labor and energy consumption for drying the tow band 60 after the relaxing entanglement. In addition, it is possible to suppress the nonwoven fabric manufacturing device 1 from being excessively wet by the tow band 60 impregnated with moisture.

The mist M contains vapor of moisture. This makes it possible to more favorably prevent the tow band 60 from being excessively wet with moisture. In the relaxing entanglement, the mist M is brought into contact with the tow band 60 in such a manner that the tow band 60 immediately before cutting in the forming short fibers has a moisture amount of a value in a range from 7 mass % to 15 mass %. This makes it possible to obtain an appropriate amount of moisture to relax the entanglement of the CA fibers 61 in the tow band 60 and to more favorably prevent the tow band 60 from being excessively wet with moisture.

As an example, the method for manufacturing the nonwoven fabric 63 of the present embodiment includes drying moisture attached to the short fibers 62 after the forming short fibers. Thus, the short fibers 62 containing moisture can be prevented from sticking to the nonwoven fabric manufacturing device 1. In addition, it is possible to prevent the formed nonwoven fabric 63 from containing unnecessary moisture.

As an example, in the forming short fibers, the tow band 60 is cut by the rotary cutter 33 that includes the cutting blade 34 disposed on a circumferential surface thereof, is pivotally supported, and is rotationally driven in such a manner that the tow band 60 comes into contact with the cutting blade 34. By using the rotary cutter 33 having such a configuration, the tow band 60 being transferred can be continuously cut, and the short fibers 62 can be more efficiently formed.

The cutting mechanism 30 does not have to include the rotary cutter 33 but may include, for example, a guillotine-type cutter as disclosed in Patent Document 1 and a feeder configured to supply the tow band 60 to the guillotine-type cutter. The guillotine-type cutter may include at least one of a pair of blades (for example, a lower blade and an upper blade) for cutting the tow band 60. When the guillotine-type cutter is used, the tension applied to the tow band 60 is adjusted by, for example, the feeding speed of the feeder. As an example, when the feeding speed of the feeder increases, the tension increases. When the feeding speed of the feeder decreases, the tension decreases. However, when the cutting mechanism 30 includes the rotary cutter 33, the short fibers 62 are formed at a relatively high speed. Thus, the manufacturing efficiency of the nonwoven fabric 63 is improved by using the rotary cutter 33, for example. When the tow band 60 is heated in the relaxing entanglement, impregnating the tow band 60 with moisture and heating the tow band 60 may be performed separately. In this case, it is possible to prevent the temperature of the tow band 60 from decreasing because of impregnation with moisture, for example by impregnating the tow band 60 with moisture then heating the tow band 60.

One tow band 60 or a bundle of tow bands 60 including a plurality of tow bands 60 may be introduced into the entanglement relaxing unit 2 and the short fiber forming unit 3. In the present embodiment, the nonwoven fabric 63 is efficiently manufactured as described above. Thus, even when the nonwoven fabric 63 is manufactured by using a bundle of tow bands 60, the nonwoven fabric 63 can be favorably manufactured. Another embodiment will be described below focusing on differences from the first embodiment.

Second Embodiment

As in the first embodiment, the entanglement relaxing unit 2 of the nonwoven fabric manufacturing device 1 according to a second embodiment is configured to spray the mist M to the tow band 60 with the nozzle 22. The mist M includes fine droplets of moisture. The particle size of the fine droplets is larger than the particle size of the vapor. As an example, the particle size of the fine droplets is a value in a range from 0.1 μm to 100 μm.

As in the first embodiment, the method for manufacturing the nonwoven fabric 63 of the present embodiment also includes, as an example, performing preparation for impregnating the tow band 60 with moisture in the relaxing entanglement before the relaxing entanglement. In addition, as an example, after the forming short fibers, drying moisture attached to the short fibers 62 is included.

In the relaxing entanglement, moisture in the form of fine droplets is sprayed onto the tow band 60 while a relatively low tension (load) having a value in a range from 2 mgf to 50 mgf per denier is applied to the tow band 60 in the transfer direction P. The CA fibers 61 in the tow band 60 are plasticized by the moisture in the form of fine droplets, and the elasticity thereof is reduced. This relaxes the entanglement between the CA fibers 61. Also in the present embodiment, as in the first embodiment, in the relaxing entanglement, the tow band 60 is impregnated with moisture in such a manner that the tow band 60 immediately before cutting in the forming short fibers has a moisture amount of a value in a range from 7 mass % to 80 mass %. As an example, in the relaxing entanglement, the mist M is brought into contact with the tow band 60 in such a manner that the tow band 60 immediately before cutting in the forming short fibers has a moisture amount of a value in a range from 7 mass % to 35 mass % (in another example, a value in a range from 15 mass % to 35 mass %). As in the first embodiment, the mist M may contain an additive. According to the present embodiment, by using moisture in the form of fine droplets, it is possible to impregnate the CA fibers 61 with a larger amount of additive than in the first embodiment.

Also in the present embodiment, the tow band 60 can be efficiently impregnated with the mist M containing moisture by using, for example, an existing spraying device or the like. Thus, the tow band 60 can be impregnated with moisture at relatively low cost. In addition, when the nonwoven fabric 63 is manufactured by using the crimped CA fibers 61 (tow band 60), the short fibers 62 having a uniform length dimension can be efficiently formed. Also in the present embodiment, the tow band 60 is impregnated with a relatively small amount of moisture in the entanglement relaxing unit 2. Thus, it is possible to omit removing excessive moisture contained in the tow band 60 between the entanglement relaxing unit 2 and the short fiber forming unit 3.

In the relaxing entanglement of the present embodiment, the mist M is brought into contact with the tow band 60 in such a manner that the tow band 60 immediately before cutting in the forming short fibers has a moisture amount of a value in a range from 7 mass % to 35 mass %. This makes it possible to set the amount of moisture with which the tow band 60 is impregnated to an appropriate amount. In the present embodiment, the mist M containing heated fine droplets may be sprayed onto the tow band 60 in the relaxing entanglement. In this case, as in the first embodiment, the CA fibers 61 in the tow band 60 are plasticized by both moisture and heat.

Third Embodiment

Figure 3:
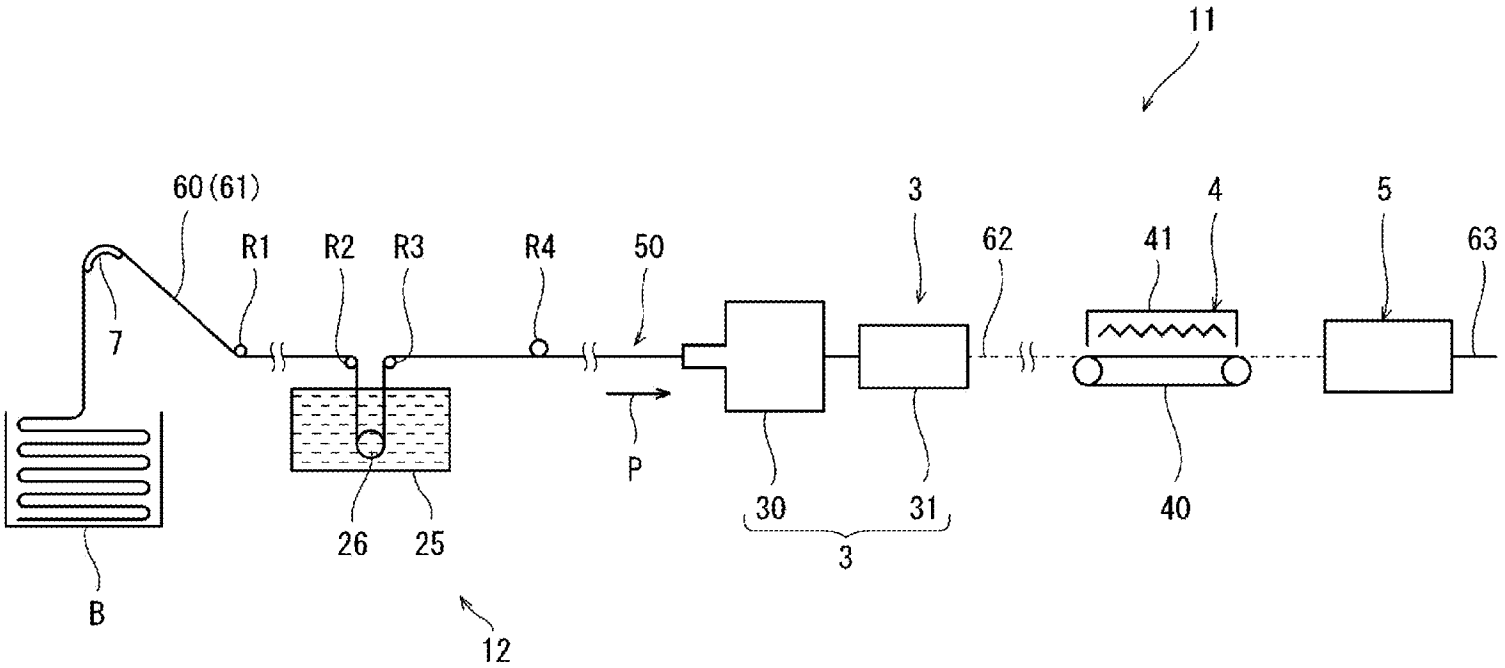
FIG. 3 is a schematic diagram of a nonwoven fabric manufacturing device according to a third embodiment.

FIG. 3 is a schematic diagram of a nonwoven fabric manufacturing device 11 according to a third embodiment. An entanglement relaxing unit 12 included in a nonwoven fabric manufacturing device 11 illustrated in FIG. 3 is configured to impregnate the tow band 60 with moisture and relaxes entanglement of the CA fibers 61 in the tow band 60 by immersing the transferred tow band 60 in water in a state where a tension is applied to the tow band 60. The entanglement relaxing unit 12 includes a reservoir 25 configured to reserve water and at least one rotating roll 26 pivotally supported inside the reservoir 25 and having a circumferential surface around which the tow band 60 is wound. The tow band 60 is wound around the circumferential surface of the rotating roll 26, and is immersed in water in the reservoir 25 while being given a tension in the transfer direction P to be impregnated with water. The water in the reservoir 25 may be at a temperature higher than room temperature (25° C.). That is, also in the present embodiment, relaxation of entanglement of the CA fibers 61 may be promoted by heating the tow band 60 in the relaxing entanglement.

The method for manufacturing the nonwoven fabric 63 of the present embodiment also includes, as an example, performing preparation for impregnating the tow band 60 with moisture in the relaxing entanglement (as an example, setting of the entanglement relaxing unit 12 in the present embodiment) before the relaxing entanglement. As an example, the method for manufacturing the nonwoven fabric 63 of the present embodiment also includes drying moisture attached to the short fibers 62 after the forming short fibers.

In the relaxing entanglement of the present embodiment, as an example, the tow band 60 is impregnated with moisture in such a manner that the tow band 60 immediately before cutting in the forming short fibers has a moisture amount of a value in a range from 7 mass % to 80 mass %. Further, as an example, in the relaxing entanglement, the tow band 60 is impregnated with moisture in such a manner that the tow band 60 immediately before cutting in the forming short fibers has a moisture amount of a value in a range of 60 mass % to 80 mass %.

In the forming short fibers, the moisture amount of the tow band 60 immediately before cutting is preferably in such an extent that the tow band 60 immersed in water does not drip water in a natural state (a value in a range of less than 100 mass %, and preferably a value in a range of 80 mass % or less). The amount of water for immersing the tow band 60 in water (the amount of water in the reservoir 25) is set to such an extent that the load applied to the short fibers 62 in drying of the short fibers 62 does not become excessive. Thus, the amount of water with which the tow band 60 is impregnated is adjusted to an appropriate amount. Also in the present embodiment, the CA fibers 61 can be plasticized by impregnating the tow band 60 with water. In addition, by impregnating the tow band 60 with heated moisture, the CA fibers 61 can be plasticized by both moisture and heat. Thus, the nonwoven fabric 63 can be efficiently manufactured by forming the short fibers 62 having a uniform length dimension.

Confirmation Test

A confirmation test will be described next, but the present disclosure is not limited to examples described below. Short fibers according to Examples 1 to 3 and Comparative Examples 1 and 2 were produced by the following procedure.

Production of Example 1

The tow band 60 was used in which the TD was set to 30,000, the FD was set to 3, and the number of crimps per inch length (the number of primary crimps) was set to 346. The number of crimps of the tow band 60 was counted by the following method. A sampled tow band 60 was placed on a table, one end of the tow band 60 in a direction in which the crimp was stretched was fixed to the table side, and the other end was hung downward from the end of the table. By applying a constant load to the other end of the tow band 60 with a weight, a constant tension was applied to the tow band 60 in the direction in which the crimp was stretched. In this state, recesses and protrusions present on the surface of the tow band 60 were made to appear by illumination. Then, the surface of the tow band 60 was photographed by an optical sensor such as a CCD camera.

The photographed image was binarized by the following method. A computer was caused to convert a pixel value (for example, luminance) of each pixel in the photographed image into "1" when the pixel value is equal to or greater than a predetermined threshold value, and into "0" when the pixel value is less than the threshold value. Subsequently, when the computer determined that there was a pixel group in which pixels having a pixel value of "1" continues in a predetermined manner in the direction in which the crimp was stretched in the tow band 60 in the converted image, the computer was caused to determine the pixel group as a mountain portion. When the computer determined that there was a pixel group in which the pixel value "0" continues in a predetermined manner in the direction in the converted image, the computer was caused to determine the pixel group as a valley portion. Further, the computer was caused to count a value obtained by dividing the total number of the valley portions and the mountain portions by 2 as the number of crimps. The number of crimps (number of primary crimps) of the tow band 60 per inch length in the direction was thus counted.

In addition, the tow band 60 was introduced into the nonwoven fabric manufacturing device 1, and the relaxing entanglement and the forming short fibers were performed by the method disclosed in the first embodiment. In the relaxing entanglement, the tension applied to the tow band 60 in the transfer direction P was set to 0.3 kgf (10 mgf per denier) in the entire tow band 60. The tow band 60 was impregnated with moisture by spraying heated vapor (100° C. or more) from the nozzle 22 to the tow band 60. In the relaxing entanglement, the moisture amount of the tow band 60 was adjusted in such a manner that the moisture amount of the tow band 60 immediately before cutting in the forming short fibers was 10.8 mass %. In the forming short fibers, the tow band 60 was cut to a target dimension of 51 mm by the cutting mechanism 30 including a guillotine-type cutter.

Production of Example 2

The tow band 60 similar to the one in Example 1 was introduced into the nonwoven fabric manufacturing device 11, and the relaxing entanglement and the forming short fibers were performed by the method disclosed in the second embodiment. In the relaxing entanglement, the tension applied to the tow band 60 in the transfer direction P was set to 0.3 kgf (10 mgf per denier) in the entire tow band 60. In the relaxing entanglement, water droplets (25° C.) were sprayed from the nozzle 22 onto the tow band 60 to impregnate the tow band 60 with water. In the relaxing entanglement, the moisture amount of the tow band 60 was adjusted in such a manner that the moisture amount of the tow band 60 immediately before cutting in the forming short fibers was 28 mass %. In the forming short fibers, the tow band 60 was cut to a target dimension of 51 mm by the cutting mechanism 30 including a guillotine-type cutter.

Production of Example 3

The tow band 60 similar to the one in Example 1 was introduced into the nonwoven fabric manufacturing device 11, and the relaxing entanglement and the forming short fibers were performed by the method disclosed in the third embodiment. In the relaxing entanglement, the tension applied to the tow band 60 in the transfer direction P was set to 0.3 kgf (10 mgf per denier) in the entire tow band 60. In the relaxing entanglement, the moisture amount of the tow band 60 was adjusted in such a manner that the moisture amount of the tow band 60 immediately before cutting in the forming short fibers was 68.4 mass %. In the forming short fibers, the tow band 60 was cut to a target dimension of 51 mm by the cutting mechanism 30 including a guillotine-type cutter.

Production of Comparative Examples 1 and 2

Short fibers of Comparative Examples 1 and 2 were formed by the same method as in Example 1 except that the relaxing entanglement was not performed but opening the tow band was performed by applying a tension in a predetermined transfer direction and a width direction to the tow band transferred in the transfer direction by a plurality of opening rolls disposed to be separated from each other in the transfer direction. In Comparative Example 1, a tow band in which the number of crimps (the number of primary crimps) per inch length before opening was 340 was used. In Comparative Example 2, a tow band in which the number of crimps (the number of primary crimps) per inch length before opening was 310 was used.

Figure 4:
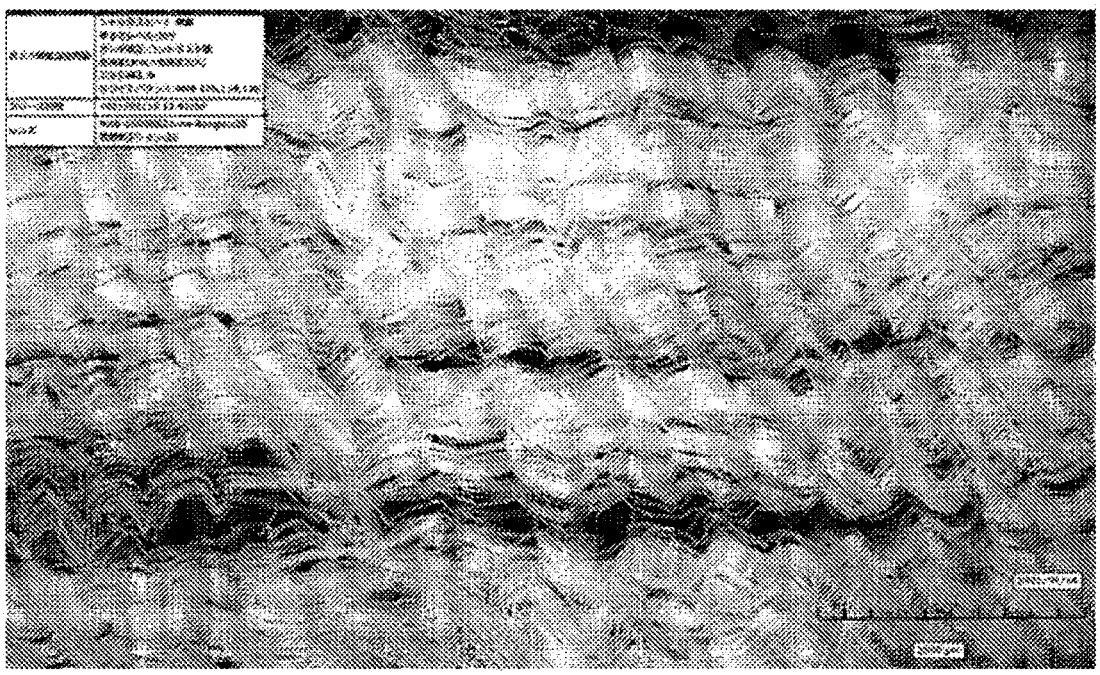
FIG. 4 is a photograph of a tow band immediately after entanglement relaxation in Example 1.
Figure 5:
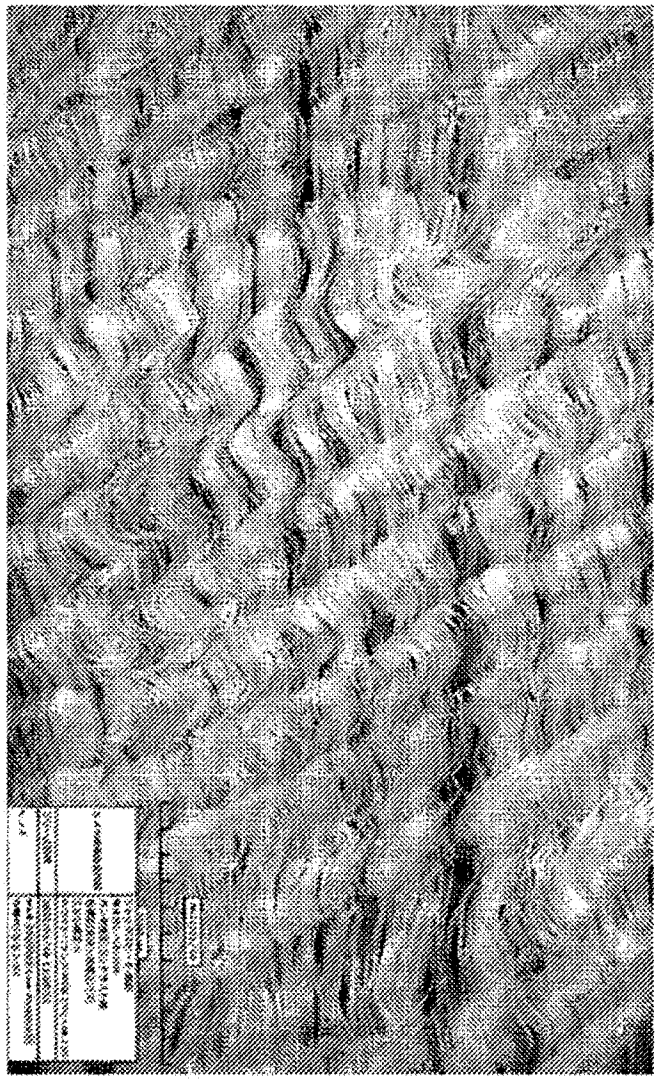
FIG. 5 is a photograph of a tow band immediately after entanglement relaxation in Example 2.

For each of the short fibers of Examples 1 to 3 and Comparative Examples 1 and 2 produced as described above, the state of the short fibers subjected to the carding treatment, the presence or absence of clogging of the short fibers in the transfer path in the short fiber manufacturing device, the uniformity of the length dimension of the short fibers, and the tactile feel of the short fibers were evaluated. The evaluation results and test results are listed in Tables 1 and 2. FIG. 4 is a photograph of the tow band 60 immediately after entanglement relaxation in Example 1. FIG. 5 is a photograph of the tow band 60 immediately after entanglement relaxation in Example 2.

TABLE 1

| | Example 1 | Example 2 | Example 3 |
|---|---|---|---|
| TD | 30000 | 30000 | 30000 |
| FD | 3 | 3 | 3 |
| Impregnation of tow band with moisture | Vapor spray (Vapor temperature 25° C.) | Fine droplet spray (Droplet temperature 25° C.) | Water immersion |
| Moisture amount of tow band immediately before cutting | 10.8 mass % | 28.0 mass % | 68.4 mass % |
| Number of crimps of tow band before entanglement relaxation | 346 | 346 | 346 |
| Number of crimps of tow band after entanglement relaxation | 340 | 338 | 336 |
| State of short fibers subjected to carding treatment | Good | Good | Good |
| Clogging of short fibers in transfer path | Absent | Absent | Absent |
| Cutter type | Guillotine type | Guillotine type | Guillotine type |
| Uniformity of length dimension of short fibers | Good | Good | Good |
| Tactile feel of short fibers (no stickiness) | Good | Good | Acceptable (no water separation) |

TABLE 2

| | Comparative Example 1 | Comparative Example 2 |
|---|---|---|
| TD | 30000 | 30000 |
| FD | 3 | 3 |
| Impregnation of tow band with moisture | Absent | Absent |
| Moisture amount of tow band immediately before cutting | Equilibrium moisture content (6.5 mass %) | Equilibrium moisture content (6.5 mass %) |
| Number of crimps of tow band before opening treatment | 346 | 310 |
| Number of crimps of tow band after opening treatment | 346 | 310 |
| State of short fibers subjected to carding treatment | Caught in machine | Caught in machine |
| Clogging of short fibers in transfer path | Present | Present |
| Cutter type | Guillotine type | Guillotine type |

TABLE 2-continued

| | Comparative Example 1 | Comparative Example 2 |
|---|---|---|
| Uniformity of length dimension of short fibers | Large variation | Large variation |
| Tactile feel of short fibers (no stickiness) | Good | Good |

As listed in Table 2, in Comparative Examples 1 and 2, the short fibers were caught (entangled) in the carding machine in the carding treatment. The tow band of Comparative Example 1 was bulky and rich in elasticity. The tow band of Comparative Example 2 also had the same level of bulkiness and elasticity as those of Comparative Example 1. Thus, in Comparative Examples 1 and 2, it was difficult to introduce the tow band into the short fiber forming unit 3. In Comparative Examples 1 and 2, the orientation of the CA fibers with respect to the cutter when the tow band was cut by the cutting mechanism 30 was not stable as compared with Examples 1 to 3. Thus, in Comparative Examples 1 and 2, relatively large variations occurred in the length dimension of the short fibers.

As shown in Table 1 and FIGS. 4 and 5, in the tow bands 60 of Examples 1 to 3, although the number of crimps of the tow band 60 after impregnation with moisture was slightly smaller than the number of crimps of the tow band 60 before impregnation with moisture, it was confirmed that the number of crimps of the tow band 60 was maintained in a substantially problem-free range. In addition, in Examples 1 to 3, it was confirmed that the entanglement of the CA fibers 61 in the tow band 60 was favorably relaxed by impregnating the tow band 60 with moisture. In Example 1, it was confirmed that the CA fibers 61 in the tow band 60 were plasticized by the heated vapor, and the relaxation of the entanglement of the CA fibers 61 in the tow band 60 was promoted. In Examples 1 to 3, it was confirmed that the carding treatment was able to be favorably performed on the plurality of short fibers 62, and a trouble such as clogging of the short fibers 62 in the transfer path 50 did not occur. In addition, in Examples 1 to 3, it was confirmed that the length dimension of the short fibers 62 was stabilized as compared with Comparative Examples 1 and 2.

The tow band 60 immediately before cutting in Example 1 had a moisture amount of 10.8 mass %, and the tow band 60 immediately before cutting in Example 2 had a moisture amount of 28 mass %. The short fibers 62 of Examples 1 and 2 were not confirmed to have a sticky feel or appearance. In addition, in Examples 1 and 2, it was not necessary to dry the tow band 60 that had passed through the entanglement relaxing unit 2 and was going to pass through the short fiber forming unit 3. In addition, in Examples 1 and 2, no noticeable trouble caused by impregnating the tow band 60 with moisture was observed. In Example 3, the amount of moisture with which the tow band 60 before cutting is impregnated is reduced to some extent. Thus, the short fibers 62 of Example 3 were not found to be sticky enough to cause water separation. From the above results, an advantage of Examples 1 to 3 relative to Comparative Examples 1 and 2 was confirmed.

Each of the configurations and the methods, combinations thereof, or the like in each of the embodiments is an example, and additions, omissions, replacements, and other changes to the configurations may be made as appropriate without departing from the spirit of the present disclosure. The present disclosure is not limited by the embodiments and is limited only by the claims. Each aspect disclosed in the present specification can be combined with any other feature disclosed herein.

In the embodiments, an example in which the nonwoven fabric 63 is manufactured by using the short fibers 62 has been described. However, the short fibers 62 may be used for a purpose other than manufacturing of a nonwoven fabric. In addition, in the nonwoven fabric manufacturing devices 1 and 11, the entanglement relaxing unit 2 and 12 are not essential. That is, in the nonwoven fabric manufacturing device 1 or 11, for example, the entanglement relaxing unit 2 and 12 may be omitted, and the tow band 60 containing the crimped CA fibers 61 and impregnated with moisture may be installed from the outside and introduced into the short fiber forming unit 3.

In the first and second embodiments, in the relaxing entanglement, the mist M is sprayed from the nozzle 22 toward the tow band 60 to impregnate the tow band 60 with moisture. However, the method for impregnating the tow band 60 with moisture is not limited to this configuration. For example, in the relaxing entanglement, the tow band 60 may be impregnated with moisture by filling the mist M in the housing 20 and passing the tow band 60 through the inside of the housing 20.

In the drying, the tow band 60 may be dried by a method other than heating. As a method for drying the tow band 60 other than drying, for example, any one of a method of blowing gas to the tow band 60 to remove moisture, a method of vibrating the tow band 60 to remove moisture, a method of centrifugally separating moisture from the tow band 60, a method of passing the tow band 60 between a pair of pivotally supported squeeze rolls (compression rolls) to squeeze moisture from the tow band 60, and a method of pulling out the tow band 60 by abutting the tow band 60 to which a tension is applied in the transfer direction P against a contact member such as a rotating roll.

In the second and third embodiments, for example, the tow band 60 impregnated with moisture in the relaxing entanglement may be dehydrated before the forming short fibers to reduce the moisture amount of the tow band 60 immediately before cutting to a certain level. As a method for reducing the moisture amount of the tow band 60, any one of the methods for drying the tow band 60 described in the drying may be employed. Thus, for example, when the rotary cutter 33 is used, occurrence of a problem or maintenance work of the cutting mechanism 30 due to excessive moisture of the tow band 60 can be suppressed by setting the moisture amount of the tow band 60 immediately before cutting to a value in a range from 7 mass % to 10 mass %, for example. Thus, the short fibers 62 can be formed with even higher manufacturing efficiency.

REFERENCE SIGNS LIST

M Mist
P Transfer direction
1, 11 Nonwoven fabric manufacturing device (short fiber manufacturing device)
2, 12 Entanglement relaxing unit
3 Short fiber forming unit
5 Nonwoven fabric forming unit
33 Rotary cutter
60 Tow band (tow)
61 Cellulose acetate fiber
62 Short fiber
63 Nonwoven fabric

The invention claimed is:

1. A method for manufacturing short fibers, the method comprising:

relaxing entanglement of crimped cellulose acetate fibers in a tow band by applying a tension in a predetermined transfer direction to the tow band transferred in the transfer direction, the tow band containing the crimped cellulose acetate fibers and being impregnated with moisture; and forming short fibers by cutting the tow band in which the entanglement is relaxed, wherein in the relaxing entanglement, the tow band is impregnated with the moisture by bringing a mist into contact with the tow band, the mist containing superheated water vapor heated to a temperature of 100° C. or higher to relax the entanglement of the crimped cellulose acetate fibers.

2. The method for manufacturing short fibers according to claim 1, wherein in the relaxing entanglement, the tow band is impregnated with moisture in such a manner that the tow band immediately before cutting in the forming short fibers has a moisture amount of a value in a range from 7 mass % to 80 mass %.

3. The method for manufacturing short fibers according to claim 1, wherein in the relaxing entanglement, the tow band is heated to promote relaxation of the entanglement.

4. The method for manufacturing short fibers according to claim 1, wherein in the relaxing entanglement, the mist is brought into contact with the tow band in such a manner that the tow band immediately before cutting in the forming short fibers has a moisture amount of a value in a range from 7 mass % to 15 mass %.

5. The method for manufacturing short fibers according to claim 1, wherein in the relaxing entanglement, the mist is brought into contact with the tow band in such a manner that the tow band immediately before cutting in the forming short fibers has a moisture amount of a value in a range from 7 mass % to 35 mass %.

6. The method for manufacturing short fibers according to claim 1, the method further comprising drying moisture attached to the short fibers after the forming short fibers.

7. The method for manufacturing short fibers according to claim 1, wherein in the forming short fibers, the tow band is cut by a rotary cutter including a cutting blade disposed on a circumferential surface of the rotary cutter, the rotary cutter being pivotally supported and rotationally driven in such a manner that the tow band comes into contact with the cutting blade.

8. A method for manufacturing a nonwoven fabric, the method comprising manufacturing a nonwoven fabric using short fibers formed by the method for manufacturing short fibers described in claim 1.

9. A short fiber manufacturing device comprising:

an entanglement relaxing structure configured to relax entanglement of crimped cellulose acetate fibers in a tow band by applying a tension in a predetermined transfer direction to the tow band transferred in the transfer direction, the tow band containing the crimped cellulose acetate fibers and being impregnated with moisture by bringing a mist into contact with the tow band, the mist containing superheated water vapor heated to a temperature of 100° C. or higher to relax the entanglement of the crimped cellulose acetate fibers; and a short fiber forming structure configured to form short fibers by cutting the tow band in which the entanglement is relaxed.

10. A nonwoven fabric manufacturing device comprising:

the short fiber manufacturing device described in claim 9; and a nonwoven fabric forming structure configured to form a nonwoven fabric using the short fibers formed by the short fiber forming structure.

* * * * *